United States Patent [19]

Soderberg et al.

[11] 4,079,782

[45] Mar. 21, 1978

[54] SELF CLEANING HEAT EXCHANGER CIRCUIT

[75] Inventors: Curt A. Soderberg, Lake Hiawatha; John Thomas Muller, Morris Plains, both of N.J.

[73] Assignee: The Leslie Company, Parsippany, N.J.

[21] Appl. No.: 731,809

[22] Filed: Oct. 12, 1976

Related U.S. Application Data

[63] Continuation of Ser. No. 523,582, Nov. 14, 1974, abandoned.

[51] Int. Cl.[2] ..... F28G 1/12

[52] U.S. Cl. ..... 165/95; 122/379; 15/3.51

[58] Field of Search ..... 122/379; 165/95, 5, 165/71, 84; 15/3.51

[56] References Cited

U.S. PATENT DOCUMENTS

| | | | |
|---|---|---|---|
| 2,670,723 | 3/1954 | Clarkson | 165/95 X |
| 2,946,569 | 7/1960 | Kirkby | 165/95 |
| 3,841,397 | 10/1974 | Eimer | 165/95 |
| 3,872,920 | 3/1975 | Honma et al. | 122/379 X |
| 3,919,732 | 11/1975 | Honma et al. | 165/95 |
| 3,978,917 | 9/1976 | Honma et al. | 165/95 |

*Primary Examiner*—Charles J. Myhre
*Assistant Examiner*—Theophil W. Streule, Jr.
*Attorney, Agent, or Firm*—Lerner, David, Littenberg & Samuel

[57] ABSTRACT

An apparatus for continuously cleaning tubular heat exchangers during use is disclosed, including a separator for continuously circulating cleaning bodies through the heat exchanger along with the heat transfer-medium being employed. The separator thus recirculates the cleaning bodies along with fresh heat transfer medium while separating out a major portion of the heat-transfer medium withdrawn from the tubular heat exchanger, and includes means for withdrawing the cleaning bodies from a downstream portion of the separator and means for withdrawing the heat-transfer medium withdrawn from the heat exchanger from an upstream portion of the separator. The separator is preferably vertically disposed, so that the cleaning bodies are aided by gravity in reaching the downstream portion of the separator, and the cleaning bodies therefore do not impinge upon any screen for separating them from the heat-transfer medium. Baffle means are also provided in the upstream portion of the separator to assure low uniform velocity distribution of the heat transfer medium, and a check valve is provided in the downstream portion of the separator to prevent reversal of the flow of heat-transfer medium at the outlet port of the separator. In addition, means are also provided for maintaining a closed loop including the cleaning bodies free from pumps, including a Venturi disposed at the downstream portion of the separator, and where pumps are employed in the closed loop, a time demand or flow demand circuit for deactivation of the pumps at regular time intervals or at conditions of low demand is provided.

14 Claims, 6 Drawing Figures

SELF CLEANING HEAT EXCHANGER CIRCUIT

This is a continuation of application Ser. No. 523,582, filed Nov. 14, 1974 now abandoned.

FIELD OF THE INVENTION

The present invention is directed to an apparatus for continuously cleaning a tubular heat exchanger during use.

More specifically, the present invention relates to apparatus for maintaining cleaning bodies in a closed loop circulating either through or between the tubes of a tubular heat exchanger.

Still more particularly, the present invention relates to apparatus for separating cleaning bodies from a heat-exchange medium without direct impingement on a screen.

Still more particularly, the present invention relates to apparatus for pumping heat-exchange medium through a closed loop including cleaning bodies without pumping a mixture of heat-exchange medium and cleaning bodies directly through any pump.

Still more particularly, the present invention relates to apparatus for separating cleaning bodies from a heat-exchange medium while insuring uniformly distributed flow velocity between the separation apparatus and the heat-exchange medium withdrawn from the system.

Still more particularly, the present invention relates to a separator for separating cleaning bodies from a heat-exchange medium whereby the reverse flow of heat-exchange medium into that apparatus is prevented.

BACKGROUND OF THE INVENTION

It has been realized for many years that the efficiency of heat exchangers has consistently decreased with use, particularly with hard water or other such fluids as the heat-transfer medium, as films or scales develop upon the heat transfer surface. Thus, particularly in tubular heat exchangers which include a series of tubes, and a heat-exchange medium is carried either between or through these tubes for heat transfer with a second heat-transfer medium through the tubes thereof, as such films or scales begin to develop on the surface of or within the tubes, the rate of heat transfer cannot be maintained without intermittantly shutting down the system and scraping or otherwise cleaning these tube surfaces.

Many systems have been suggested for continuously operating such heat exchangers, and particularly wherein discrete particles or cleaning bodies are maintained in the flow of either of the media, i.e. either through the tubes themselves or between the tubes. Thus, U.S. Pat. No. 3,021,117 to Taprogge discloses a self-cleaning heat-exchanger which employs rubbing bodies, such as sponge rubber particles in a continuous loop passing through the individual tubes 19 of the heat exchanger in order to continuously contact the surface thereof and maintain same free from particulate buildup. In order to recirculate same, however, the patent teaches the use of a device for intercepting and conducting the rubbing bodies to a return device, comprising a funnel-shaped strainer 23 or other screen or grating, which permits the water removed from the discharge end of the heat-exchanger to pass onward but collects the rubbing bodies for return back to the inlet end of the heat exchanger. This device thus requires that the funnel or strainer 23 directly intercept the swiftly moving rubbing bodies, which thus impinge directly on the surface thereof. For this reason the use of more substantial rubbing bodies, such as steel balls, would not be practicable in this invention since damage would occur to the screen 23 during use.

Another such system for continuously cleaning the tube surfaces of tubular heat exchangers is disclosed by Treplin in U.S. Pat. No. 3,219,195. In this apparatus, the cleaning bodies 5, which are preferably elastic in character and have the specific weight of the cooling water, are recirculated by their collection from the water discharged from the heat exchanger in sieve 6*a* and 6*b*, and then directed into a sluice 9 provided with a sieve basket 10. These bodies are thus permitted to enter the sluice 9 through line 8, which passes through sieve basket 10, when valve 12 is open, and subsequently these cleaning bodies are permitted to re-enter the fluid stream through line 16, which enters sluice 9 through sieve basket 10, when valve 13 is opened. The continuous opening and closing of valves 12 and 13 is therefore required in this device, and again the cleaning bodies impinge directly upon a screen or sieve 6*a* and 6*b* for collection as the water passes therethrough.

Yet another such device is taught in U.S. Pat. No. 1,795,358 to Schmidt, which employs small hard objects, such as balls, for passage through the heat exchanger tubes. While the use of such hard objects is particularly helpful in preventing the buildup of foreign material on the surface of such heat exchange tubes, several additional difficulties are prevented therewith. Thus, this patent requires the use of a suitable screen 24 again to intercept the balls 37 passing from the outlet side of the heat exchanger for return, and additionally the balls 37 must pass through the pump 31 for re-introduction back to the inlet side of the heat exchanger. Considerable damage is thus caused to the pump after continuous use with these hard metal objects therein.

It is therefore apparent that in each of these systems the cleaning bodies are collected for re-circulation by impinging directly upon a screen or sieve, which is therefore subject to damage, particularly when harder objects such as steel balls are employed. Furthermore, each of these prior art techniques require that the cleaning bodies pass through a pump for re-circulating same, therefore subjecting that pump to considerable damage and necessary replacement.

It is therefore an object of the present invention to provide an apparatus which is capable of overcoming each of these difficulties encountered in these devices of the prior art.

SUMMARY OF THE INVENTION

In accordance with the present invention it has been discovered that these and other objects may be accomplished by providing an apparatus for continuously cleaning a tubular heat exchanger during use, wherein the heat exchanger includes a plurality of tubes whereby heat is transferred between two heat-transfer media, one of which is circulated through the tubes and the other between the tubes, including a closed loop system for re-circulating cleaning bodies in at least one of said media, and providing a separator for separating and re-circulating said cleaning bodies along with a fresh supply of heat-transfer medium. The separator includes an upstream portion and a downstream portion, and means for withdrawing cleaning bodies from the downstream portion of the separator, and means for withdrawing a portion of the heat-transfer medium from a point located at the upstream portion of the separator. In this manner, the demand for the heat transfer medium will determine what portion thereof is withdrawn from the point located at the upstream portion of the separator, i.e. when the demand on the system is zero, all the heat-transfer medium withdrawn from the heat exchanger will be withdrawn from the downstream portion of the separator along with the cleaning bodies. The separator is preferably disposed vertically so that the cleaning bodies are aided by gravity in travelling in a first direction in thus reaching the downstream portion of the separator, and a portion of the heat-transfer medium separated from the cleaning bodies is withdrawn in a second direction, preferably transverse to the direction of flow, in said first direction, of the heat-transfer medium and cleaning bodies withdrawn from the tubular heat exchanger.

In another embodiment, the separator includes means for withdrawing the cleaning bodies carried by heat-transfer medium in a first direction, and means for directing the flow of a portion of the heat-transfer medium to be separated from the flow of heat-transfer medium and cleaning bodies exiting from the heat exchanger in a second direction at a location upstream from the means for withdrawing heat transfer medium carrying cleaning bodies without preventing the flow of said cleaning bodies in said first direction. Preferably this means for directing the flow of heat-transfer medium comprises an outlet port located at a point upstream from the means for withdrawing the heat-transfer medium carrying cleaning bodies from the separator in said first direction.

In a preferred embodiment the separator includes baffle means in its upstream portion, associated with the means for withdrawing the major portion of heat-transfer medium separated from the cleaning bodies withdrawn from the tubular heat exchanger, in order to assure low uniform velocity distribution of the heat-transfer medium. In addition, a check valve is provided in the downstream portion of the separator, in order to prevent the reverse flow of heat-transfer medium withdrawn from the separator along with the cleaning bodies.

In another preferred embodiment of the present invention, a closed loop system for re-circulating the cleaning bodies continuously through the heat exchanger is provided whereby the cleaning bodies do not pass directly through any pumps within that closed loop. Preferably, flow means are provided at the point where the cleaning bodies are withdrawn from the downstream portion of the separator so that the cleaning bodies and heat-transfer medium so withdrawn are re-circulated by contacting a rapidly flowing stream of fresh transfer medium directed by a pump located outside the closed loop, and injected through the flow means, such as a Venturi or other such means, and into which the cleaning bodies pass.

In a preferred embodiment the check valve includes cleaning body deflector means for directing the cleaning bodies to cleaning body exit ports, which exit ports include flexible sleeve members which permit the flow of heat-transfer medium and cleaning bodies therethrough from the separator, but which prevent the reverse flow of heat-transfer medium through the exit ports back into the separator.

In another embodiment, where a closed loop system for re-circulating cleaning bodies is employed, and pump means are provided within the closed loop system for assisting in re-circulating said cleaning bodies, control means are provided for intermittently deactivating the pump means. In this manner, excessive wear and/or damage to the system is prevented. The control means may be independently activated by timing means independent of any system parameters, or, in a preferred embodiment, are activated and deactivated with regard to the demand for the portion of heat-transfer medium to be withdrawn from the point located at the upstream portion of the separator.

DETAILED DESCRIPTION

Figure 1:
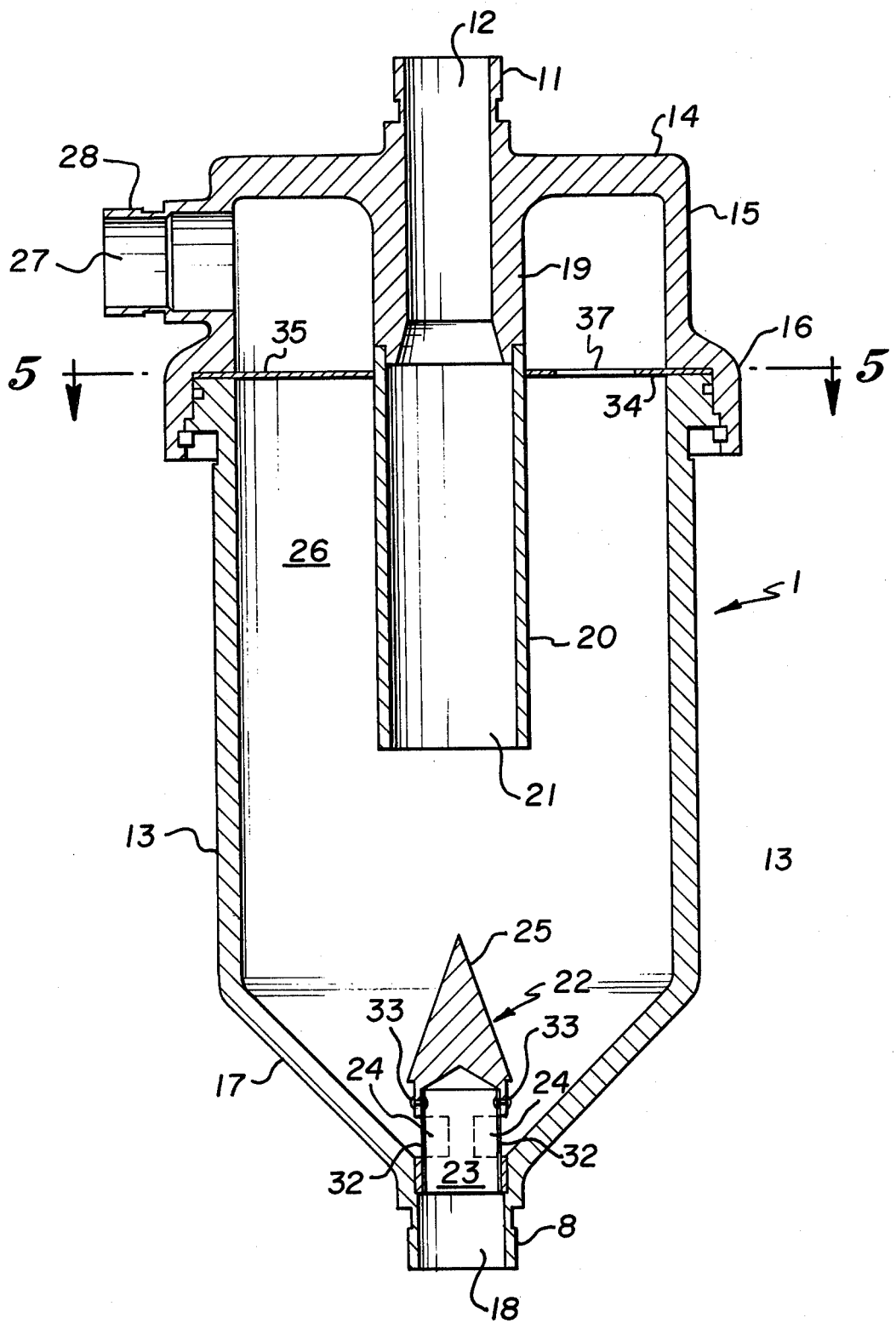
FIG. 1 is a sectional elevational side view of the separator of the present invention.
Figure 6:
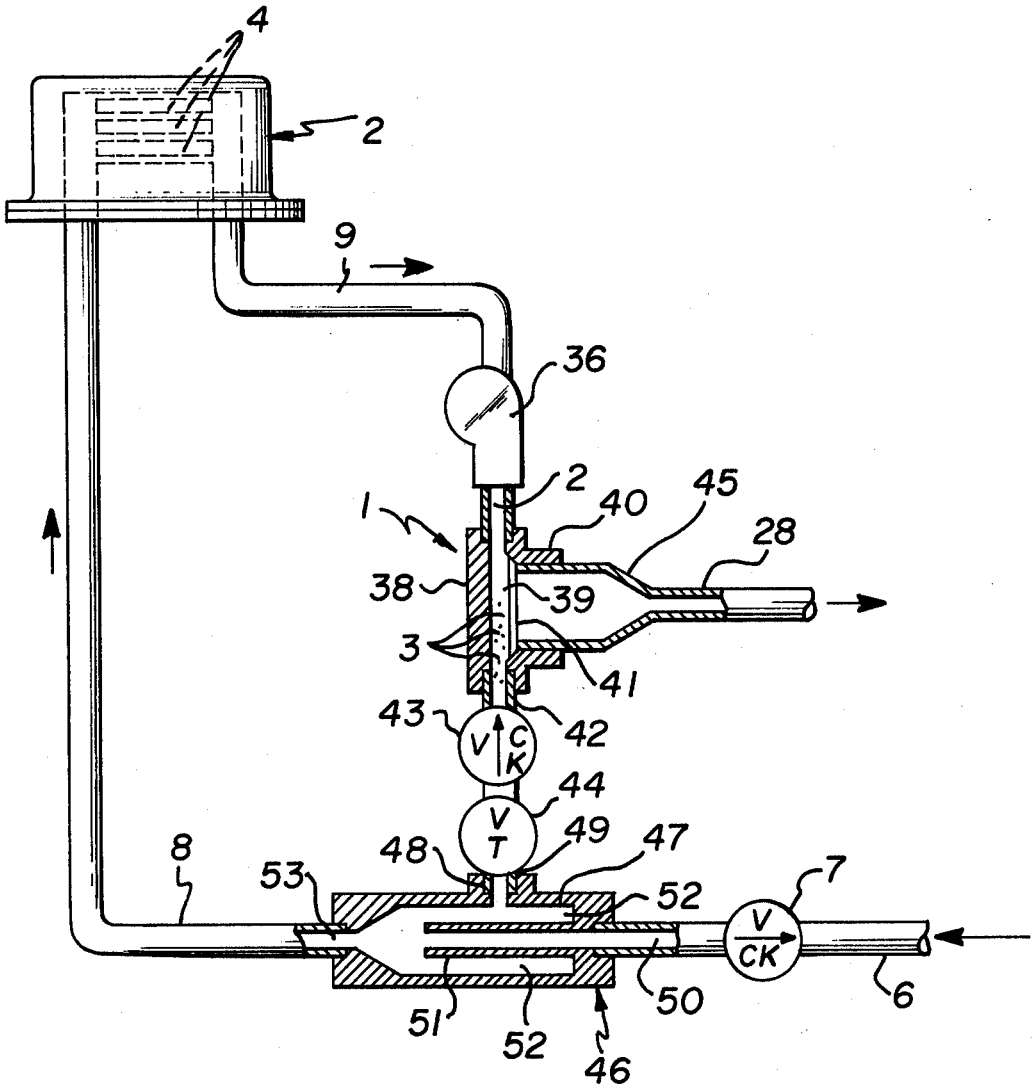
FIG. 6 is a schematic view of another separator of the present invention, including in a closed loop system for continuously cleaning a heat exchanger.

Referring to the Figures, in which like designations refer to like portions thereof, FIG. 1 shows a separator of the present invention for use in a closed loop system for continuously cleaning the tubular surfaces of a tubular heat exchanger with cleaning bodies. The separator 1 thus receives a heat-transfer medium which has been withdrawn from a tubular heat exchanger 2. This heat-transfer medium thus includes cleaning bodies 3 which, after separation from at least a major portion of the heat-transfer medium withdrawn from the heat exchanger 2 in the separator 1, are re-circulated along with fresh heat-transfer medium back to the heat exchanger 2. In this manner, the cleaning bodies 3 remain in a closed loop system and are continuously effecting the cleaning of the surface of the tubes 4, as shown in FIG. 6, of the tubular heat exchanger 2.

The cleaning bodies themselves may be of either a regular or irregular shape, but preferably are hard, spherical balls, preferably composed of steel. In this manner the cleaning bodies can effectively remove scale and other buildup upon the surface of the tubes 4 in the tubular heat exchanger 2 as they pass therethrough.

Figure 2:
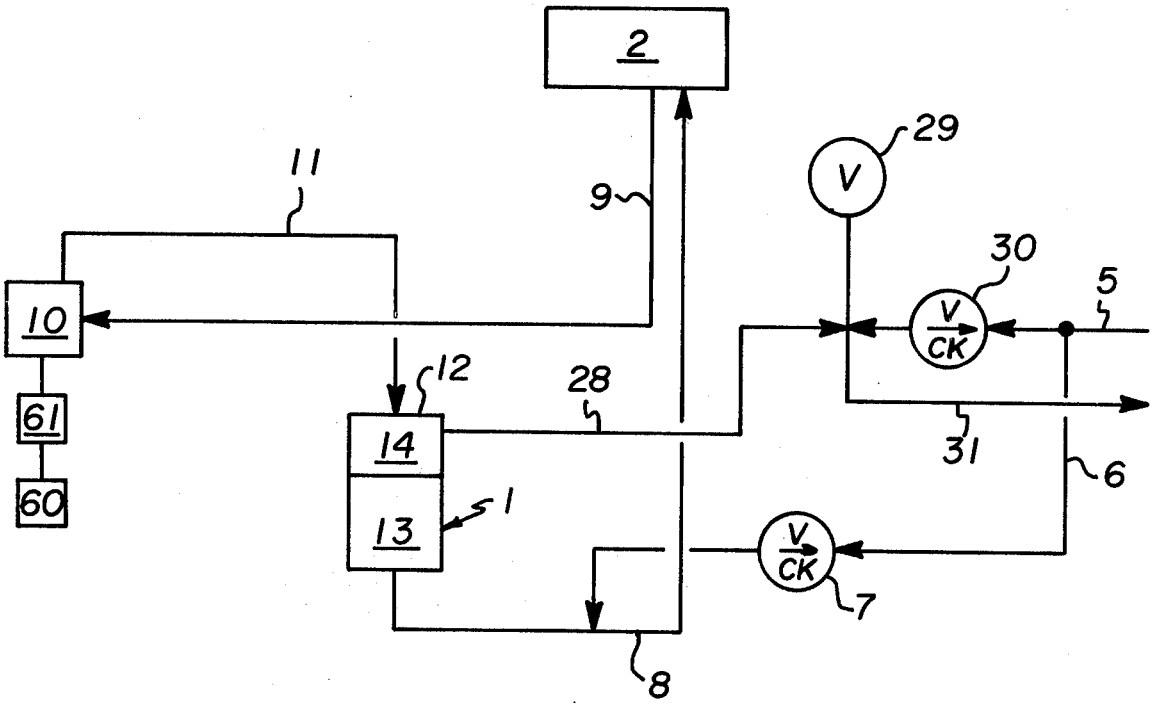
FIG. 2 is a schematic view of the closed loop system of the present invention, including the separator of the present invention, showing its association with heat-transfer fluid supply and delivery means.

The overall environment in which the heat exchanger 2 operates can be seen in FIG. 2, wherein the heat exchanger 2 is employed to heat the heat-exchange fluid such as water, passing through the inside of the tubes therein. A supply of cold water is thus provided by cold water line 5, which travels through line 6, and check valve 7, into line 8 of the closed loop system. Line 8 contains the cleaning bodies after removal from the separator 1. The fresh or cold heat-transfer medium along with the cleaning bodies withdrawn from the separator 1 thus pass through line 8 into the heat exchanger 2. In the heat exchanger they pass through the inside of heat exchange tubes 4, and as shown in FIG. 6 the heat-transfer medium is thus heated by a hot heat-transfer fluid, steam or other such media, which surrounds the tubes 4 within the heat exchanger 2. The heated heat-transfer medium, still including the cleaning bodies 3, then passes from the heat exchange tubes 4 through line 9 into pump 10 from which the heated heat-transfer media and cleaning bodies are pumped through line 11 into the inlet port 12 of the separator 1.

The separator 1 itself comprises a main separator housing 13, which includes a removable cover portion 14 which thus provide access to the interior of separator 1. The removable cover 14 thus includes a generally cylindrical portion 14 and a flange portion 16 which is adapted to interlock with the top of the main separator housing 13. The main separator housing 13 thus includes a cylindrical portion, and a conical lower portion 17 which terminates in exit port 18. Removable cover 14 includes an inner extending conduit portion 19 which thus forms a extension of line 11 through inlet port 12 into the interior of the separator 1. Furthermore, a tubular conduit 20 is attached to inner conduit portion 19, such as by welding or other means, to provide a further extension of inlet port 12 into the interior of main separator housing 13. In this manner, heated heat-transfer medium and cleaning bodies passing from the heat exchanger 2 into the separator 1 through line 11 may be carried directly into the main separator housing portion 13 of separator 1, exiting from the end of tubular conduit 20. Where, as is highly preferred, housing 1 is maintained in a vertical position as shown in FIG. 1, this passage of hot heat-transfer medium and cleaning bodies is aided by the force of gravity. The generally conical portion 17 of separator housing 13 terminates, as stated above, in exit port 18, which corresponds to line 8 for withdrawing the cleaning bodies 3, along with the used heat-transfer medium, from the separator 1 and returning same to heat-exchanger 2, along with fresh heat-transfer media supplied to line 8 by line 6, as described above. At exit port 18 a particle directing deflector 22 is provided. Thus, particle directing deflector 22 includes a generally cylindrical portion 23, including slots 24 which permit the passage of cleaning bodies 3 therethrough, and into exit port 18. Particle directing deflector 22 also includes a conical portion 25 on top of cylindrical portion 23. This conical portion, which is preferably at an angle of less than about 60°, thus directs cleaning bodies exiting from the open end 21 of tubular conduit 20 to slots 24 in the cylindrical portion 23. The cleaning bodies are further carried to slots 24 by the force of gravity acting upon them, as well as by the velocity of the flow of heat-transfer medium itself, and by rolling along the conical portion 17 of the main separator housing 13.

The cleaning bodies 3, at least partially because of their weight, are all thus directed downwardly through slots 24 and particle directing deflector 22, and thus through exit port 18. Under zero demand conditions, that is, when no hot heat-transfer medium is being withdrawn from the system through line 31 as seen in FIG. 2, the fluid and cleaning bodies entering the separator main housing section 13 through entrance port 21 all exit through exit port 18. However, depending upon the degree of demand on the system through line 31, the rate of flow out of the separator through exit port 27 is determined. That is, increased demand thus increases the flow of hot heat-transfer medium from exit port 27, which in turn increases the demand for fresh heat-transfer medium into the system through line 6. The portion of heat-transfer medium thus determined by this demand passes through exit port 27, located on removable cover 14, and preferably directed transverse to the flow of heat-transfer medium and cleaning bodies into separator 1. This heat-transfer medium thus exiting from exit port 27 is carried by line 28 to blending valve 29 wherein additional fresh heat-transfer medium may be added to this stream through line 5, and finally through line 31 into the system where the demand arises. In accordance therewith the resultant mixture flows out of the system through line 31 at a controlled temperature in accordance with the operation of the blending valve.

Referring again to particle directing deflector 22, a flexible elastomeric sleeve 32 is provided as a flap to cover slots 24 in the cylindrical portion 23 of particle directing deflector 22. The flexible elastomeric sleeve 32 is thus cylindrical in shape, in order to normally close off slots 24. The elastomeric sleeve itself 32 is bolted to the cylindrical portion 24 of particle directing deflector 22 by bolts or rivets 33. Thus, upon the application of pressure to the outside of flexible sleeve 32, such as by the pressure of heat-transfer medium and/or cleaning bodies 3 within the separator 1, the flexible sleeve 32 is easily pushed inwardly, thus permitting the flow of heat-transfer medium and cleaning bodies through slots 24 and into exit portion 18. On the other hand, the back flow of heat-transfer medium from exit port 18 into separator 1 is prevented since such flow would force flexible sleeve 32 outwardly, against the surface of slots 24, thus preventing the flow of heat-transfer media therethrough. Thus, the reverse flow of such fluid, particularly at times of high demand for fluid through exit port 27, is prevented.

Figure 5:
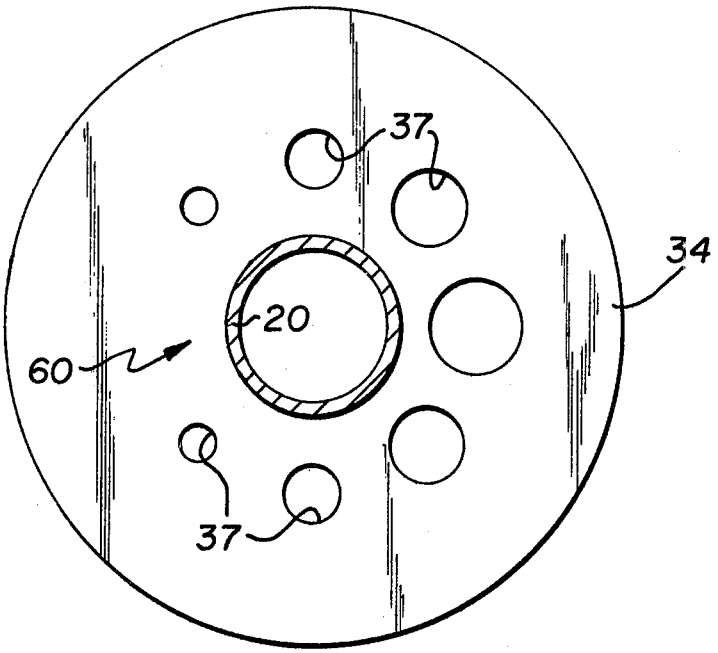
FIG. 5 is an elevational top view, partly sectional, of a baffle of the present invention for association with the separator of FIG. 1.

Furthermore, a baffle 34, as specifically shown in FIG. 5, is provided in annular space 26. The annular baffle 34 is thus maintained in its radial position by placement between the end face of main separator housing 13 and the lip portion 35 of removable cover 14. Annular baffle 34 thus includes circular ports 37, which are arranged about the circumference of baffle 34 in a manner to assure low uniform velocity distribution within the main separator housing 13. This is accomplished by providing a series of circular ports 37 around the circumference of annular baffle 34, each of which is preferably substantially larger than each of the cleaning bodies 3. It is unnecessary to provide ports 37 which are smaller than cleaning bodies 3, since the cleaning bodies do not impinge upon baffle 34, but are directed, preferably at least in part by the force of gravity, directly to particle directing deflector 22. Preferably, there is no port 37 at a location 60 on baffle 34, corresponding to the point where exit port 27 is located in separator 1, and most preferably, the ports 37 will be of increasing diameter, as shown in FIG. 5, the largest diameter circular port 37 being located the greatest distance from exit port 27. This again assures uniform velocity distribution of fluid leaving separator 1 through exit port 27.

In addition, specifically referring to FIG. 2 hereof, control means 60 are provided in order to regulate the operation of pump 10. That is, where the closed loop system of the present invention includes a pump 10 therein in order to effect the re-circulation of the cleaning bodies through the closed loop system, there will be eventual wear and/or damage to the pump itself by contact with the cleaning bodies, particularly where the aforementioned steel balls are employed. For this reason, it is important to minimize the total use of pump 10. This may be accomplished by deactivating pump 10 periodically, such as by employing a timer as control means 60, independent of any parameters effecting the closed loop system, or preferably by employing a circuit such that control means 60 activates and deactivates pump 10 in accordance with the demand upon the system for additional heat-transfer medium through line 31. That is, when the demand through line 31 is low, or zero, no additional cold water will enter the closed loop system through line 6, and the flow through the closed loop system will be minimal, or zero. It will then be necessary, preferably after a time delay, to activate pump 10 through control means 60. On the other hand, when the demand through line 31 is high, the flow of fresh heat-transfer medium into the closed loop system will necessarily be increased, and it will then be possible to deactivate or shut off pump 10. Again, it is not necessary to provide for the cleaning bodies 3 to be constantly re-circulating throughout the closed loop system, but periodic re-circulation will generally be sufficient to maintain the tubes 4 in heat exchanger 2 substantially clean and free of scale, etc. Thus, it is preferable to employ a flow detector 61, which is any conventional means for detecting a predetermined level of fluid flow through a point in the demand circuit, and generate an electrical signal in response to that flow. The interruption of this signal, in turn, is used to actuate timer 60, and after the passing of a predetermined period of time on timer 60, pump 10 is actuated thereby. Thus, the pump 10 can be actuated to cause circulation in the closed loop after a predetermined flow has been detected in the demand circuit so that the closed loop system is cleaned.

In another embodiment of the separator of the present invention, as shown in FIG. 6, the heated heat-transfer medium and cleaning bodies exit heat exchanger 2 through line 9, as previously described. The separator 1 in this case includes a main cylindrical separator housing 38, and a projecting cylindrical exit port 40 surrounding opening 39, for the withdrawal of a portion of the heat-transfer medium from the separator 1. The entrance into cylindrical passage 40 may be covered by a screen 41 which would prevent the passage of any of the cleaning bodies 3 through opening 39. It should be noted, however, that screen 41 is not in the path of travel of the cleaning bodies 3 through the separator 1, and the cleaning bodies therefore do not impinge directly upon screen 41 when it is employed. Within exit port 40 is exit conduit 45 for directing the flow of hot heat-transfer medium from separator 1, thus leading into line 28 to the system. Thus, in this system, the demand on the closed loop circuit shown in FIG. 6 is determined by the demand for hot heat-transfer medium through line 28 from the system. At the point where the cleaning bodies and heat-transfer medium exit the separator 1, through exit port 42, is located a check valve 43, which may be substantially similar to the check valve described in accordance with the separator shown in FIG. 1, or which may be any other conventional check valve employed to prevent the flow of heat-transfer medium carrying cleaning bodies back into separator 1 through exit port 42. In addition, a valve 44 may be included downstream from exit port 42 in order to restrict the flow of heat-transfer medium carrying cleaning bodies from separator 1. In this manner, even in times of low demand, it would be possible to increase the flow of heat-transfer medium through line 28 by restricting the flow of heat-transfer medium through valve 44. Again, as described above, a pump 36 may be employed in line 9 for assisting in the re-circulation of cleaning bodies 3 through the closed loop system, and it may again be controlled by control means 60 as shown in FIG. 2 in the manner described above.

In a method for re-circulating cleaning bodies 3 back to heat exchanger 2 with fresh heat-transfer medium entering through line 6, through check valve 7, an injector 46, as shown in FIG. 6, is provided. The injector 46 includes the generally cylindrical body 47, and an entrance port 48 which corresponds to exit line 49 associated with throttling valve 44. Fresh heat-transfer medium enters the injector 46 from line 6 through port 50, with which is associated tubular conduit 51 which extends a major portion of the distance into injector 46, used preferably at least past the point where entrance port 48 enters the main body 47 of injector 46. In this manner, cleaning bodies and heated heat-transfer medium enter injector 46 through entrance port 48, and into an annular space 52 surrounding tubular conduit 51, and fresh heat-transfer medium enters injector 46 through tubular conduit 51, at increased flow velocities, so that the cleaning bodies 3 are picked up by the rapidly-flowing stream of fresh heat-transfer medium and carried into line 8 through exit port 53.

Figure 3:
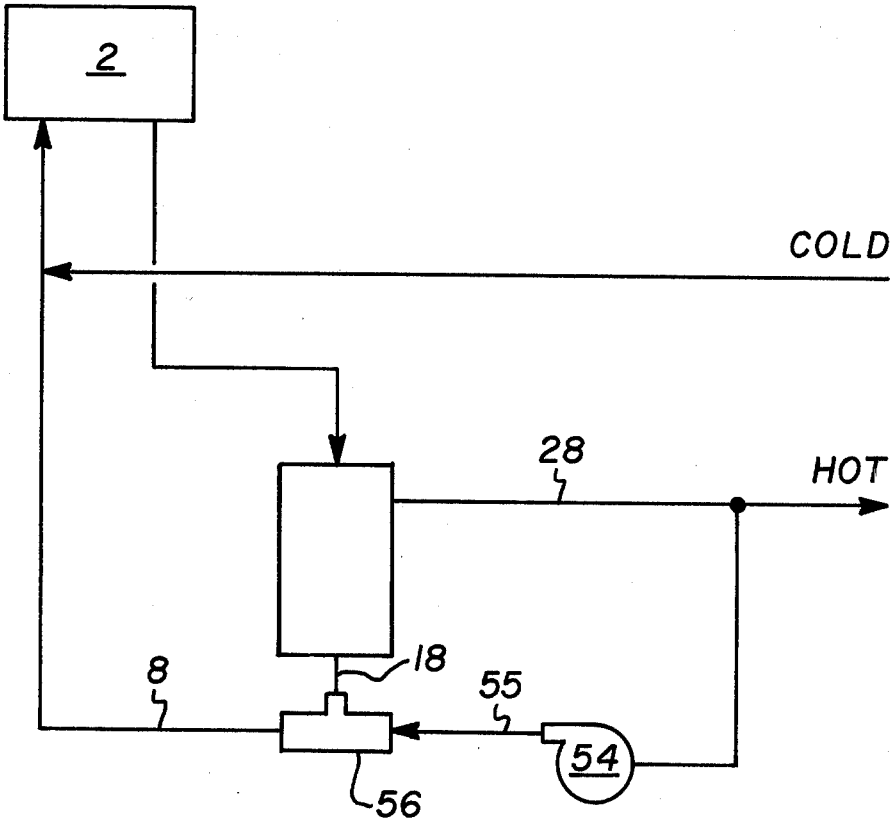
FIG. 3 is a schematic view of another form of the closed loop system of the present invention for continuously cleaning a heat exchanger.
Figure 4:
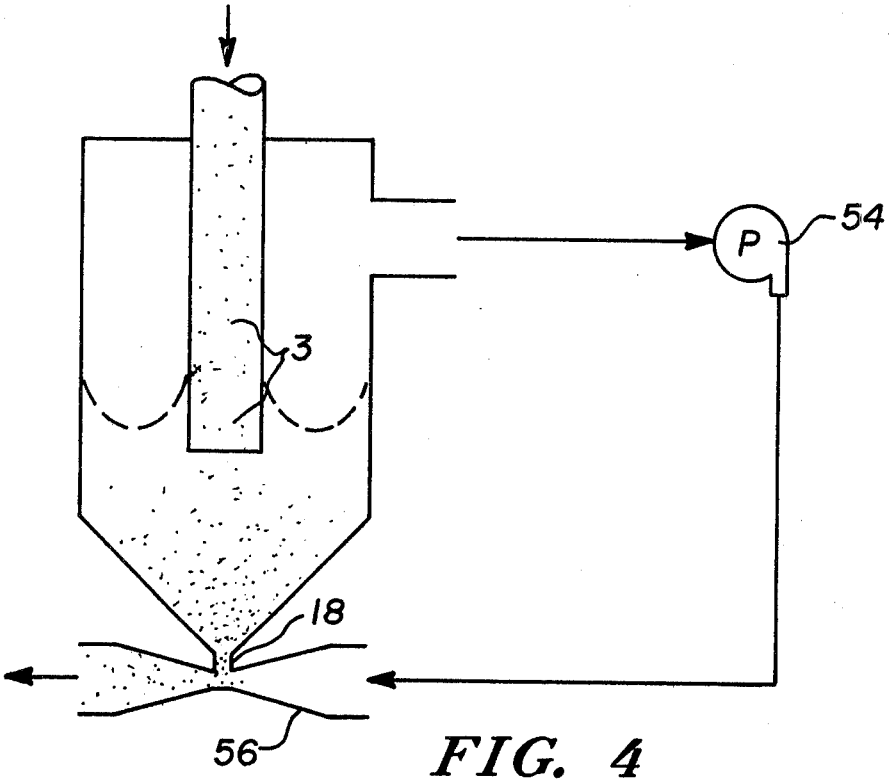
FIG. 4 is a reduced sectional side view of a separator of the present invention including a Venturi associated with the exit thereof.

Referring now to FIGS. 3 and 4, a method for maintaining the closed loop system carrying cleaning bodies 3 through heat exchanger 2 without passing cleaning bodies 3 through any pumps, is shown. Thus, heat-transfer medium, preferably withdrawn from line 28, passes through pump 54, and then through line 55, which includes a Venturi-shaped fitting 56. While a Venturi-shaped fitting 56 is preferred, other means such as orifices or obrupt restrictions may also be used, in order that a localized high velocity low pressure inductor effect is created so that relatively high mass flow pump discharge stream from pump 54 will pick up any cleaning bodies 3 directly at the Venturi-shaped or other fitting so employed. Thus, Venturi 56 is located at exit port 18 of separator 1, from which cleaning bodies 3 exit, along with heat-transfer medium. The rapidly flowing heat-transfer medium passing through Venturi 56 picks up cleaning bodies 3 and carries them into line 8, and back to heat exchanger 2.

In addition, while the use of baffle 34 in separator 1 is preferred, particularly in order to insure low uniform velocity distribution with the separator 1, this baffle is optional, or may be replaced by a screen or mesh having holes smaller than the cleaning bodies 3. Furthermore, additional variations and modification within the overall concept of the present invention will be apparent to those skilled in this art.

What is claimed is:

1. In an apparatus for continuously cleaning a heat exchanger during use, said heat exchanger comprising a plurality of tubular members adapted for heat transfer therethrough between a liquid medium which contacts the surface of said members and a liquid medium travelling through said members, by including cleaning bodies in at least one of said liquid media, the improvement which comprises:

a separator for separating said cleaning bodies from at least a portion of said liquid medium carrying said cleaning bodies after said liquid medium carrying said cleaning bodies has exited from said heat exchanger;

said separator comprising a separator body having an upper section, a middle section and a lower section, said sections being in liquid communication therebetween;

inlet means comprising a conduit terminating in said middle section of said separator body for introducing all of said liquid medium carrying said cleaning bodies into said separator body at a point in said middle section;

first withdrawing means for withdrawing said cleaning bodies from said separator body at a point in said lower section, said inlet means and said first withdrawing means being arranged to define a substantially unidirectional path such that said cleaning bodies flow in said path from said middle section to said lower section; and second withdrawing means for withdrawing said portion of said liquid medium from said separator body at a point in said upper section, said second withdrawing means being displaced from said path defined by said inlet means and said first withdrawing means.

2. The apparatus of claim 1 wherein said separator body is vertically disposed, so that said cleaning bodies are carried to said first withdrawing means for withdrawing said cleaning bodies from said by the force of gravity.

3. The apparatus of claim 1 wherein said first withdrawing means body comprises a conical surface and outlet means located at the apex of said conical surface.

4. The apparatus of claim 3 including deflector means at said outlet means, said deflector means including exit ports for permitting the passage of said cleaning bodies therethrough.

5. The apparatus of claim 1 wherein said second withdrawing means comprises an exit pipe extending from said upper section of said separator.

6. The apparatus of claim 1 wherein said cleaning bodies flow in a first direction within said separator body and said second means for withdrawing includes means for directing the flow of said portion of said medium in a second direction.

7. The apparatus of claim 1 further including control means for controlling the flow of said portion of said medium, said control means being disposed within said separator body between said upper and middle sections thereof.

8. The apparatus of claim 4 wherein said exit ports include means for preventing the flow of heat-transfer medium into said separator through said exit ports.

9. The apparatus of claim 7 wherein said control means include baffle means for providing a substantially uniform flow distribution of said portion of said medium withdrawn from said separator body through said second withdrawing means.

10. The apparatus of claim 9 wherein said baffle means includes a plurality of baffle ports, said baffle ports having a diameter greater than the outside diameter of said cleaning bodies.

11. The apparatus of claim 1 including pump means for re-circulating said cleaning bodies to said heat exchanger.

12. The apparatus of claim 11 including control means for intermittently activating said pump means.

13. The apparatus of claim 12 including detection means for activating said control means in response to the flow of heat-transfer medium from said separator to said heat exchanger.

14. The apparatus of claim 13 wherein said control means comprises a timer for activating said pump means a predetermined period of time after activation of said detection means.

* * * * *